US010638830B2

(12) United States Patent
Robinson, II et al.

(10) Patent No.: US 10,638,830 B2
(45) Date of Patent: May 5, 2020

(54) NEAT HAND-WASHING SYSTEM

(71) Applicant: Colgate-Palmolive Company, New York, NY (US)

(72) Inventors: Michael Paul Robinson, II, Brooklyn, NY (US); Dana Gold, Glen Ridge, NJ (US)

(73) Assignee: Colgate-Palmolive Company, New York, NY (US)

( * ) Notice: Subject to any disclaimer, the term of this patent is extended or adjusted under 35 U.S.C. 154(b) by 46 days.

(21) Appl. No.: 15/577,054

(22) PCT Filed: Mar. 25, 2016

(86) PCT No.: PCT/US2016/024263
§ 371 (c)(1),
(2) Date: Nov. 27, 2017

(87) PCT Pub. No.: WO2016/195784
PCT Pub. Date: Dec. 8, 2016

(65) Prior Publication Data

US 2018/0153291 A1 Jun. 7, 2018

Related U.S. Application Data

(60) Provisional application No. 62/168,019, filed on May 29, 2015.

(51) Int. Cl.
*A46B 5/02* (2006.01)
*A46B 7/04* (2006.01)
(Continued)

(52) U.S. Cl.
CPC ..... *A46B 5/02* (2013.01); *A46B 7/04* (2013.01); *A46B 9/005* (2013.01); *A46B 11/001* (2013.01);
(Continued)

(58) Field of Classification Search
CPC . A46B 11/0006; A46B 11/001; A46B 11/002; A46B 11/0062; A46B 11/0065; A46B 11/0095
(Continued)

(56) References Cited

U.S. PATENT DOCUMENTS 1,185,617 A 6/1916 Blaha et al.
2,311,367 A * 2/1943 Chambers ..... A45D 34/04 141/20.5
(Continued)

FOREIGN PATENT DOCUMENTS

CH 406 544 1/1966
EP 0363307 4/1990

OTHER PUBLICATIONS

CleanPath + Replenish concentrate System, http://www.mycleanpath.com/#refills, downloaded from the Internet May 28, 2015.
(Continued)

*Primary Examiner* — Huyen D Le

(57) ABSTRACT

The present disclosure provides a system including a handheld implement having a handle and a head. The system also includes a base having a basin, a pump, and a product container. The basin includes vertical walls forming mouth opening to an inner cavity that receives the head of the handheld implement. The product container includes a reservoir of product. The pump conveys the product from the reservoir to the inner cavity via at least one through-hole in the basin.

14 Claims, 12 Drawing Sheets

(51) Int. Cl.

| | |
|---|---|
| ***A46B 9/00*** | (2006.01) |
| ***A46B 11/00*** | (2006.01) |
| ***A46B 15/00*** | (2006.01) |
| ***A46B 17/06*** | (2006.01) |
| ***A47L 17/04*** | (2006.01) |
| *A46B 17/04* | (2006.01) |
| *A47K 7/03* | (2006.01) |

(52) U.S. Cl.
CPC ..... *A46B 11/002* (2013.01); *A46B 11/0006* (2013.01); *A46B 15/0097* (2013.01); *A46B 17/06* (2013.01); *A47L 17/04* (2013.01); *A46B 11/0062* (2013.01); *A46B 11/0065* (2013.01); *A46B 15/0095* (2013.01); *A46B 17/04* (2013.01); *A46B 2200/3006* (2013.01); *A46B 2200/3013* (2013.01); *A46B 2200/3033* (2013.01); *A47K 7/03* (2013.01)

(58) Field of Classification Search
USPC ..... 4/188 R; 401/188 R
See application file for complete search history.

(56) References Cited

U.S. PATENT DOCUMENTS

| | | | | |
|---|---|---|---|---|
| 2,521,882 | A | 9/1950 | Swift | |
| 2,767,417 | A | 10/1956 | Amen | |
| 3,231,145 | A | 1/1966 | Converse | |
| 3,319,837 | A | 5/1967 | Mueller | |
| 4,252,455 | A | 2/1981 | De La Pena | |
| 4,411,376 | A | 10/1983 | Bennett et al. | |
| 4,963,045 | A | 10/1990 | Willcox | |
| D315,268 | S | 3/1991 | Lindauer | |
| 5,397,194 | A | 3/1995 | Yuan et al. | |
| 5,945,076 | A * | 8/1999 | Leonard | A47K 11/10 134/184 |
| 5,983,432 | A | 11/1999 | Jones | |
| RE37,190 | E | 5/2001 | Stowell et al. | |
| 6,250,833 | B1 | 6/2001 | Perry | |
| 6,309,124 | B1 * | 10/2001 | Gueret | A45D 34/045 401/123 |
| 6,942,412 | B2 * | 9/2005 | Gueret | A45D 34/045 401/123 |
| 7,066,674 | B2 * | 6/2006 | Gueret | A45D 34/04 401/125 |
| 7,377,296 | B2 * | 5/2008 | Gueret | A45D 34/042 141/113 |
| 7,850,043 | B2 | 12/2010 | Foster | |
| 8,152,025 | B2 | 4/2012 | Foster | |
| 2005/0199648 | A1 | 9/2005 | Schiller et al. | |
| 2006/0216102 | A1 | 9/2006 | Kraus et al. | |
| 2012/0003028 | A1 | 1/2012 | Beaty et al. | |
| 2012/0006853 | A1 | 1/2012 | Lim | |
| 2012/0305606 | A1 | 12/2012 | Lee et al. | |

OTHER PUBLICATIONS

Full Circle Bubble Up Brush, http://www.fullcirclehome.com/products/catalog/products/scrubitoff/61/bubbleup/, downloaded from the Internet May 28, 2015.

International Search Report and the Written Opinion of the International Searching Authority issued in International Application PCT/US2016/024263 dated Jun. 6, 2016.

OXO Soap Dispensing Palm Brush Brushes & Sponges, Good Grips Soap Dispensing Palm Brush, http://www.oxo.com/p297goodgripssoapdispensingpalmbrush. Aspx, downloaded from the Internet May 28, 2015.

* cited by examiner

NEAT HAND-WASHING SYSTEM

CROSS-REFERENCE TO RELATED PATENT APPLICATIONS

This application claims the benefit of priority to U.S. Provisional Patent Application Ser. No. 62/168,019, filed May 29, 2015, the entirety of which is incorporated herein by reference.

BACKGROUND

Hand-washing systems for cleaning various items by hand, such as dishes, counter tops, furniture, etc., often include various fluid-dispensing brushes. Such a fluid-dispensing brush conventionally includes a reservoir of liquid cleaning product within a body of the brush. Using a valve mechanism within the conventional brush, a user can dispense the cleaning product from the reservoir directly onto bristles of the brush.

BRIEF SUMMARY

The present disclosure is generally directed to hand-washing systems and, more specifically, to hand-washing systems that dispense a product onto a handheld implement. Embodiments of the present disclosure provide a system comprising a handheld implement having a handle and a head. The system also comprises a base including a basin, a pump, and a product container. The basin includes vertical walls forming a mouth opening to an inner cavity that receives the head of the handheld implement. The product container includes a reservoir of product. The pump conveys the product from the reservoir to the inner cavity via at least one through-hole in the basin.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
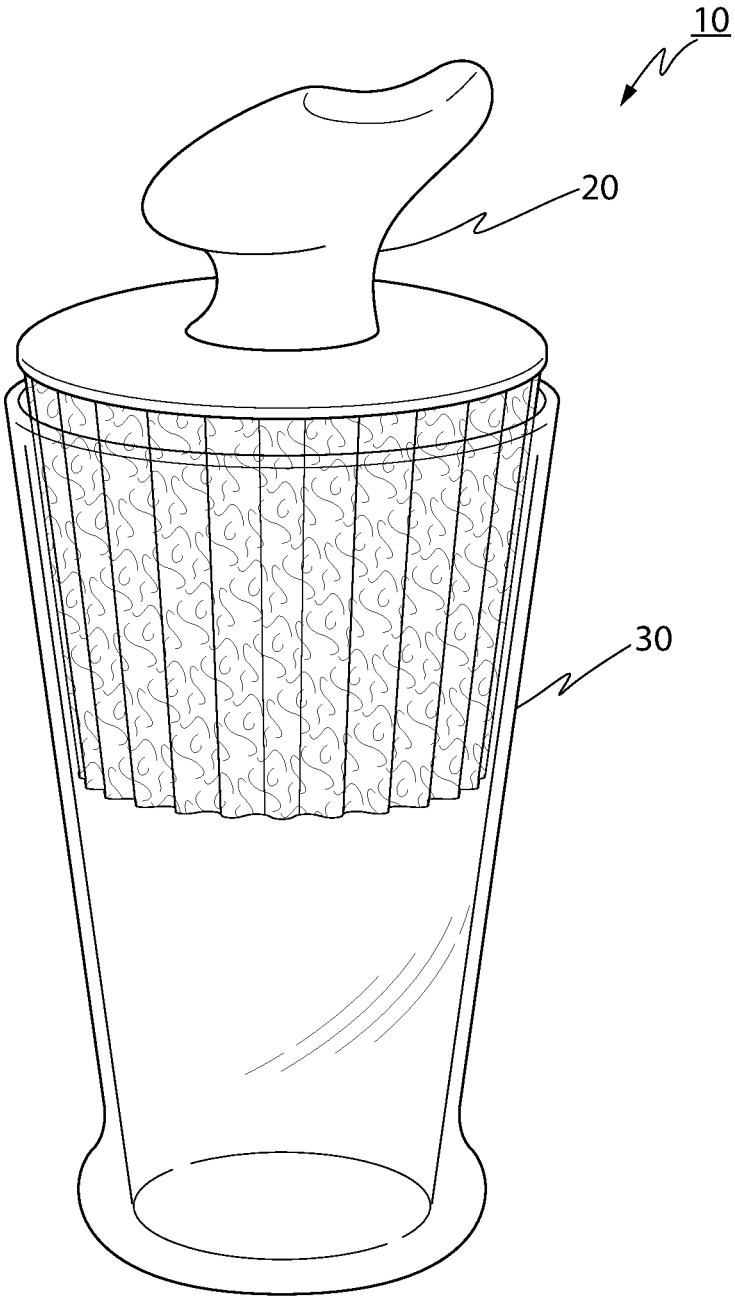
FIGS. 1 and 2 illustrate side elevation views of an exemplary system in accordance with aspects of the present disclosure.

The present disclosure is directed to a hand-washing system comprising at least one handheld implement and at least one base that is physically separable from the handheld implement and that dispenses a product onto the at least one handheld implement via a basin. A handheld implement in accordance with aspects of the invention has a body, including a handle and a head. In embodiments, the handheld implement is a kitchen implement, and the head is a brush, a sponge, a scrubber, a scraper, an abrasive pad, or the like. It is understood, however, that the handheld implement can include various types of applicators, such as a sponge, an abrasive pad, a trowel, a roller, etc.

In accordance with aspects of the present disclosure, the base includes the basin, a pump, and a reservoir of liquid or semi-liquid product. The basin can have substantially vertical walls forming a mouth opening to an inner cavity that receives the handheld implement. The pump can be, for example, a one-way flow control mechanism that conveys or allows flow of the product from the reservoir into the inner cavity of the basin via at least one through-hole at a bottom of the basin. The bottom of the basin can be a substantially flat or concave surface. In embodiments, the pump can be a well-type pump located at or below the bottom of the basin and above the reservoir.

In accordance with aspects of the present disclosure, the handheld implement has a shape corresponding to the shape of the basin, such that at least the head can pass through the mouth of the basin and extend to the bottom of the basin. The inner cavity may be initially devoid of the product. By inserting the handheld implement into the base and applying a plunging force (e.g., a substantially uniform downward, vertical force) using the handle, a user can actuate the pump to actively or passively convey the product from the reservoir into the inner cavity of the basin via the at least one through-hole, where the product pools and is picked-up by the head of the handheld implement. In embodiments, the plunging force is applied from the head of the handheld implement to the bottom of the cavity, which directly or indirectly actuates the pump. For example, the handheld implement can be a kitchen brush (e.g., a palm brush), wherein the head is a bristle attachment. A user can dispense a soap product from the reservoir into the basin by inserting the head of the kitchen brush to contact the bottom of the basin and actuating the pump by applying the plunging force on the bottom and directly or indirectly the pump via the bristle attachment.

Additionally or alternatively, in accordance with aspects of the present disclosure, the plunging force is applied to the base by the body of the handheld implement (in addition to or instead of the force applied by the head), for example, to reduce wear-and-tear (e.g., deformation) of the head that may result from the plunging force. In embodiments, the body of the handheld implement engages the walls of the basin when the head is inserted into the base. The plunging force applied to the base can be transferred to the pump through the walls of the basin while a gap is maintained between the head of the handheld implement and the bottom of the basin. The plunging force actuates the pump to actively or passively convey the product from the reservoir to the inner cavity of the basin, where it pools and is picked-up by the head. For example, the handheld implement may be a kitchen brush having a body with at least one shoulder that mates with a least one corresponding ridge on the walls of the basin. The handheld implement and the base can be proportioned such that, when the handheld implement is inserted into the base and force applied by a user, a gap is maintained between the end of the handheld implement and the bottom of the basin, while the brush is dunked into the pool of the cleaning product which is formed and replenished by the pumping.

Advantageously, hand-washing systems in accordance with aspects of the present disclosure neatly and efficiently dispense liquid or semi-liquid products onto heads of the handheld implements. This is because excess product dispensed from the reservoir remains in the basin such that the excess is not wasted when, for example, it drips from the head. Subsequently, a user can replenish the product on the head using the excess product pooled in the basin. And, when the excess is depleted, the user can replenish the pool of product in the basin using the handheld implement.

The embodiments disclosed herein are merely exemplary in nature and is in no way intended to limit the invention, its application, or uses. As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 2:
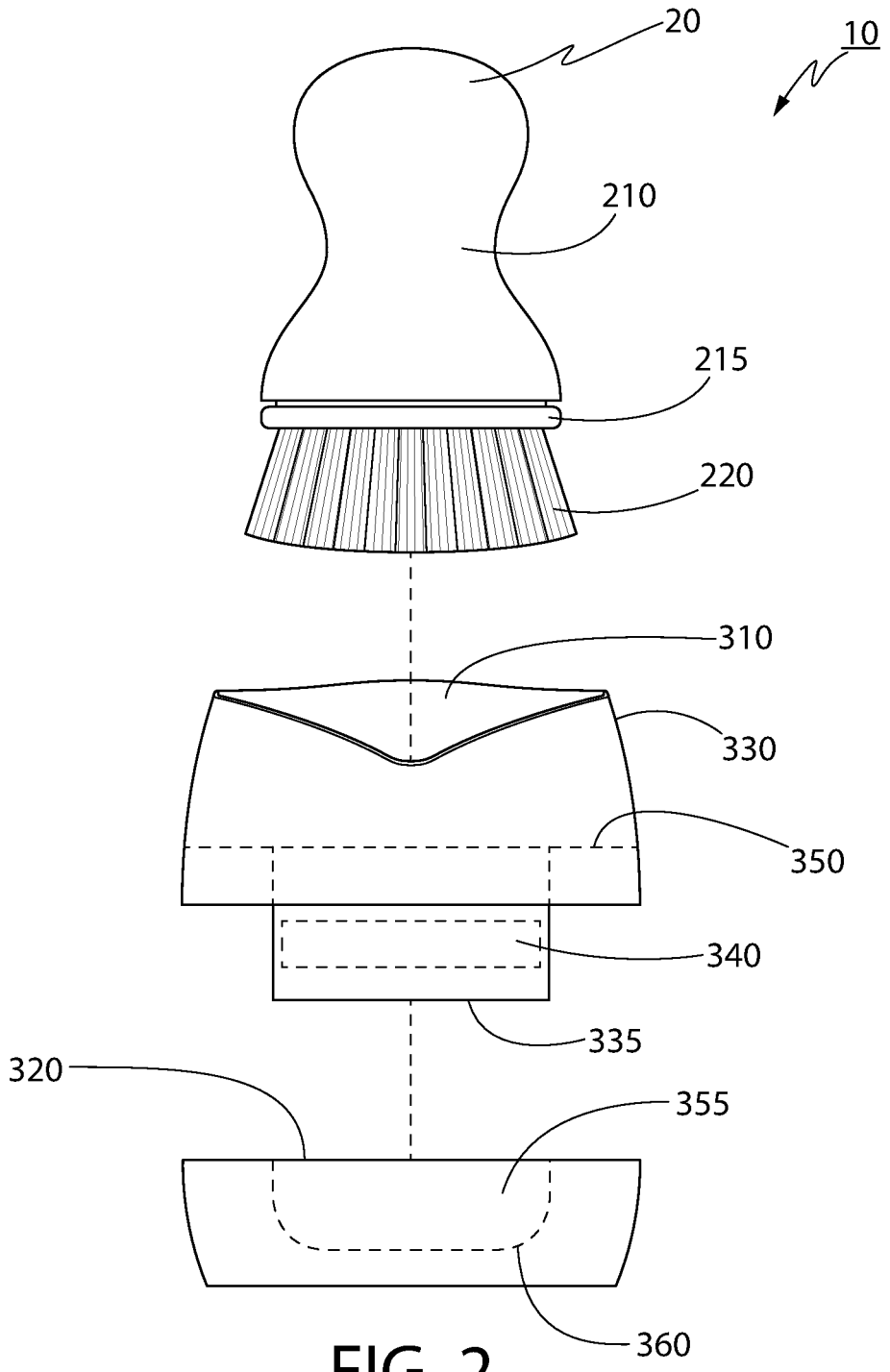

FIGS. 1 and 2 illustrate side elevation views of an exemplary system 10 in accordance with aspects of the present disclosure. The system 10 includes a handheld implement 20 and a base 30, which can be the same as those described previously herein. The handheld implement 20 has a body 210 and a head 220. In embodiments, the body 210 comprises a handle and the head 220 comprises a cleaning implement. It is understood that the handheld implement 20 in not limited to cleaning tools and can by any type of handheld applicator, such as those previously described herein.

In accordance with aspects of the present disclosure, the handheld implement 20 and the base 30 are formed from one or more substantially rigid materials (e.g., plastic, metal, glass, etc.). In embodiments, the material can be plastic formed by, for example, thermoforming, or injection molding. The selection a material can depend on the type of application for which the handheld implement 20 is used and/or type of product stored in the base 30.

In accordance with aspects of the present disclosure, the base 30 includes a basin 310 and a product container 320. The basin 310 can include substantially vertical walls 330 and a bottom section 335, which allows product conveyed from the product container 320 to pool in the basin 310. The bottom section 335 may be a substantially horizontal or concave surface. As depicted in FIG. 1, the walls 330 can form a mouth that opens to an inner cavity on the upper-side of the basin 30. The walls 330 can be a single continuous wall or a plurality of contiguous walls. The bottom section 335 of the basin 30 forms a well that securely holds a pump 340 (e.g., a well pump). In embodiments, the bottom section 335 includes an upper surface and/or a lower surface that captures the pump 340 in the bottom section 335.

The product container 320 includes product 355 held in a reservoir 360. The reservoir 360 can be a rigid or collapsible chamber. In embodiments, product 355 can be a liquid or semi-liquid cleaning product, such as soap or detergent. However, embodiments of the present disclosure are not limited to cleaning products, and the product container 320 can contain other products in the form of liquids, semi-liquids, gels, and pastes. For example, the product container 320 can contain creams, lotions, ointments, cosmetics, adhesives, oils, paints, dyes, stains, pastes, oral care products, etc.

In accordance with aspects of the present disclosure, the handheld implement 20, the basin 310, and the product container 320 stack into an integral unit, wherein the handheld implement 20 provides or acts as a re-sealable cap or lid for the base 30. In embodiments, the head 220 fits inside the mouth of the basin 30 and directly contacts the bottom surface of the inner cavity of the basin 30 (which can include the inner surface of the walls 330 and/or an upper surface of the pump 340). Further, in embodiments, the body 210 and head 220 of the handheld implement 20 are proportioned such that a shoulder 230 of the body 210 mates with a ridge 350 of the basin 320 such that the head 220 extends to the bottom surface 353 of the basin 30 without substantially contacting the bottom surface 353 of the basin 30. In embodiments, the shoulder 230 and the ridge 350 include corresponding threading (e.g., a quarter-turn fastener), such that a user can manually lock/unlock the handheld implement 10 to/from the base 30. For example, the threading can provide a twist-lock mechanism, in which a user applies downward pressure while twisting the handheld implement 20 to lock and/or unlock it from the base 30.

In accordance with aspects of the present disclosure the basin 310 is stacked on top of the product container 320. In embodiments, the basin 310 and the product container 320 are detachably locked together. For example, a bottom of the basin 310 and a top of the product container 320 can include complementary shapes (e.g., a mating edge or threads) that securely attach the product container 320 to the basin 310 (e.g., by snap-fitting, twist-locking, or screwing). Accordingly, the product container 320 is detachable such that it can be replaced or refilled.

Figure 3:
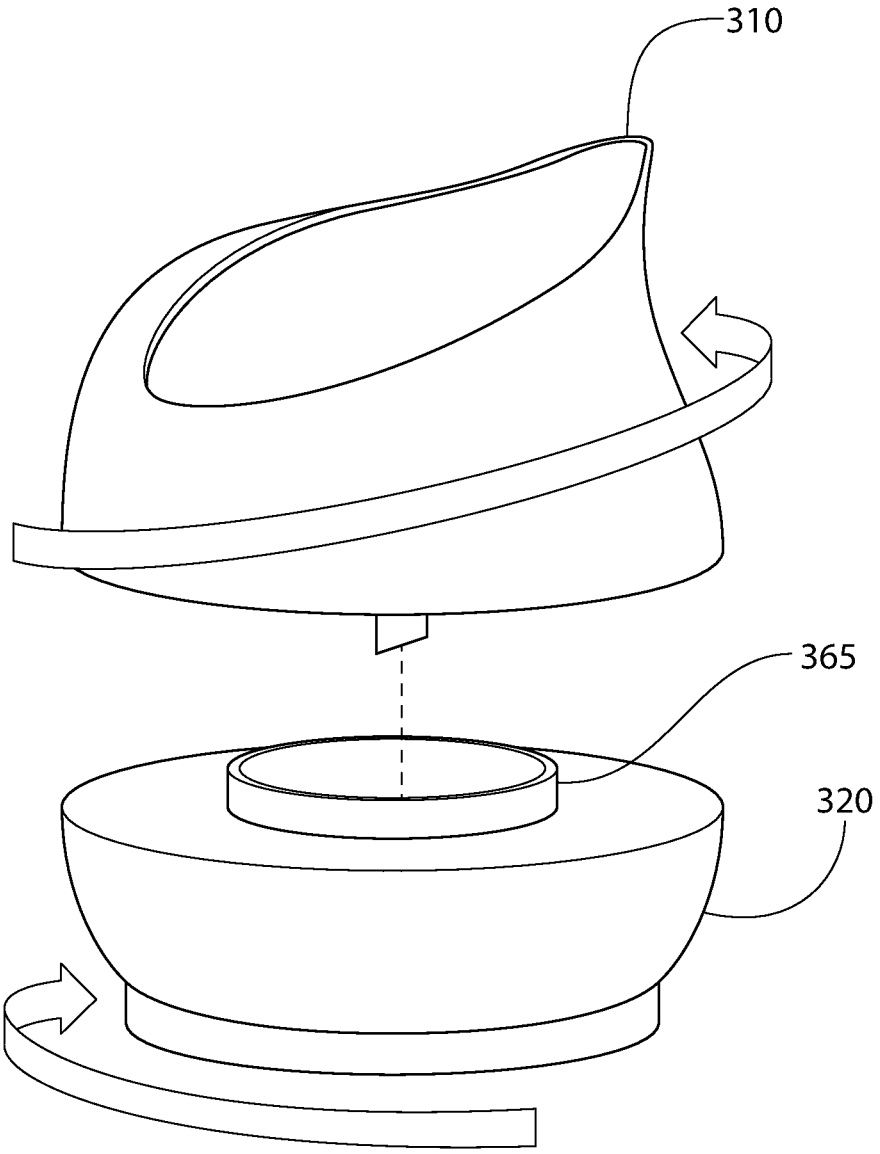
FIG. 3 illustrates an example of detaching a product container from a base in accordance with aspects of the present disclosure.

FIG. 3 illustrates an example of the product container 320 being detached from the basin 310 in accordance with aspects of the present disclosure. In embodiments, the product container 320 and the basin 310 are attached/detached using a twist-lock mechanism, such as previously discussed above. For example, an upper-side of the product container 320 can have a threaded pedestal 365 and a bottom-side of the basin 310 can include a corresponding threaded portion (e.g., bottom section 335) that mates with the threaded pedestal 365.

Figure 4:
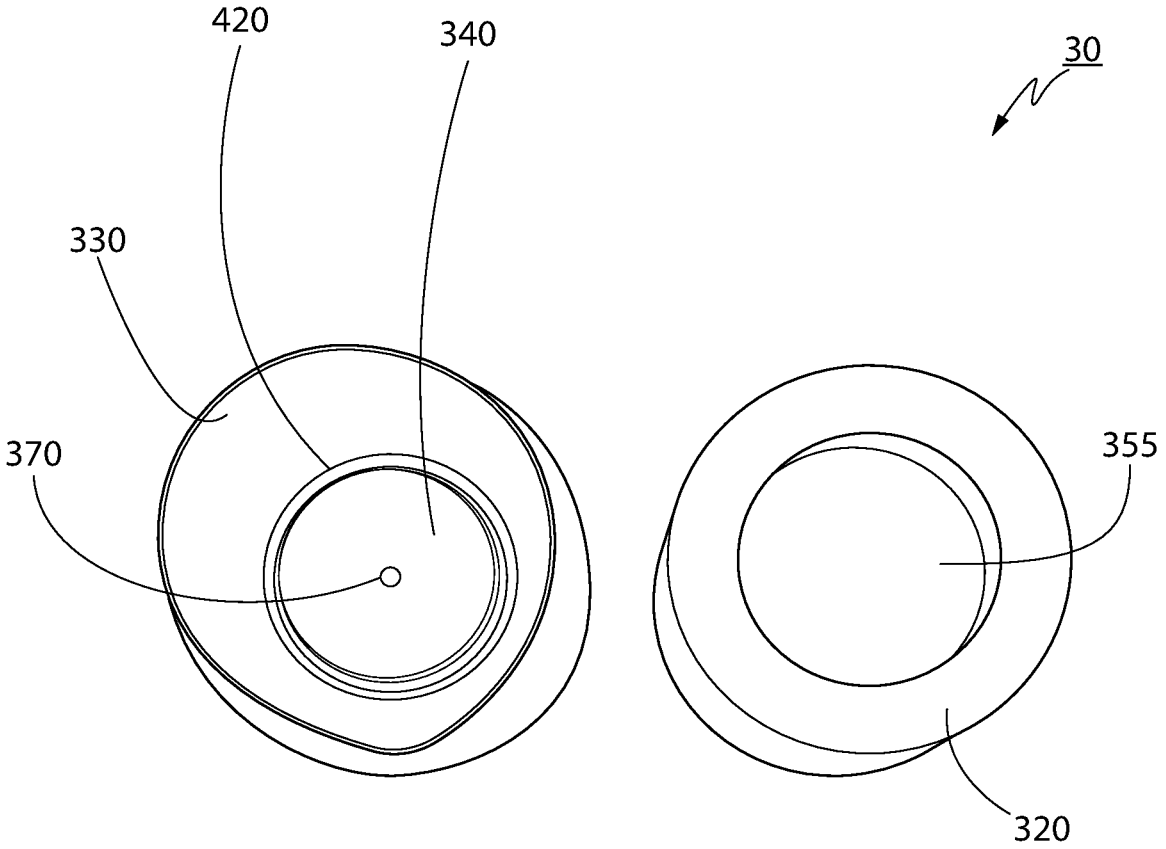
FIG. 4 depicts a top view of an exemplary base in accordance with aspects of the present disclosure.

FIG. 4 depicts a top view of an exemplary base 30 that is disassembled, in accordance with aspects of the present disclosure. The base 30 includes basin 310 and product container 320, and pump 340, all of which can be the same or similar to those previously discussed herein. The well pump 340 can be integrated into the basin 310. In embodiments, the entire bottom of the basin 310 comprises a horizontal upper face of the pump 340. For example, the walls 330 of the basin 310 can form a retaining lip 420 (e.g., a retaining ring) formed by a through-hole in the basin 340 over a bottom section (e.g., bottom section 335), The retaining lip 420 can mate with an outer edge of the 340 pump, such that pump 340 is captured between the retaining lip 420 and a lower surface basin 30 (e.g., a lower surface of the bottom section 335 or an upper surface of the product container 320). Thus, when the basin 310 is attached to the product container 320, the pump 340 can convey product from the reservoir 360 to the inner cavity of the basin 310.

Figure 5:
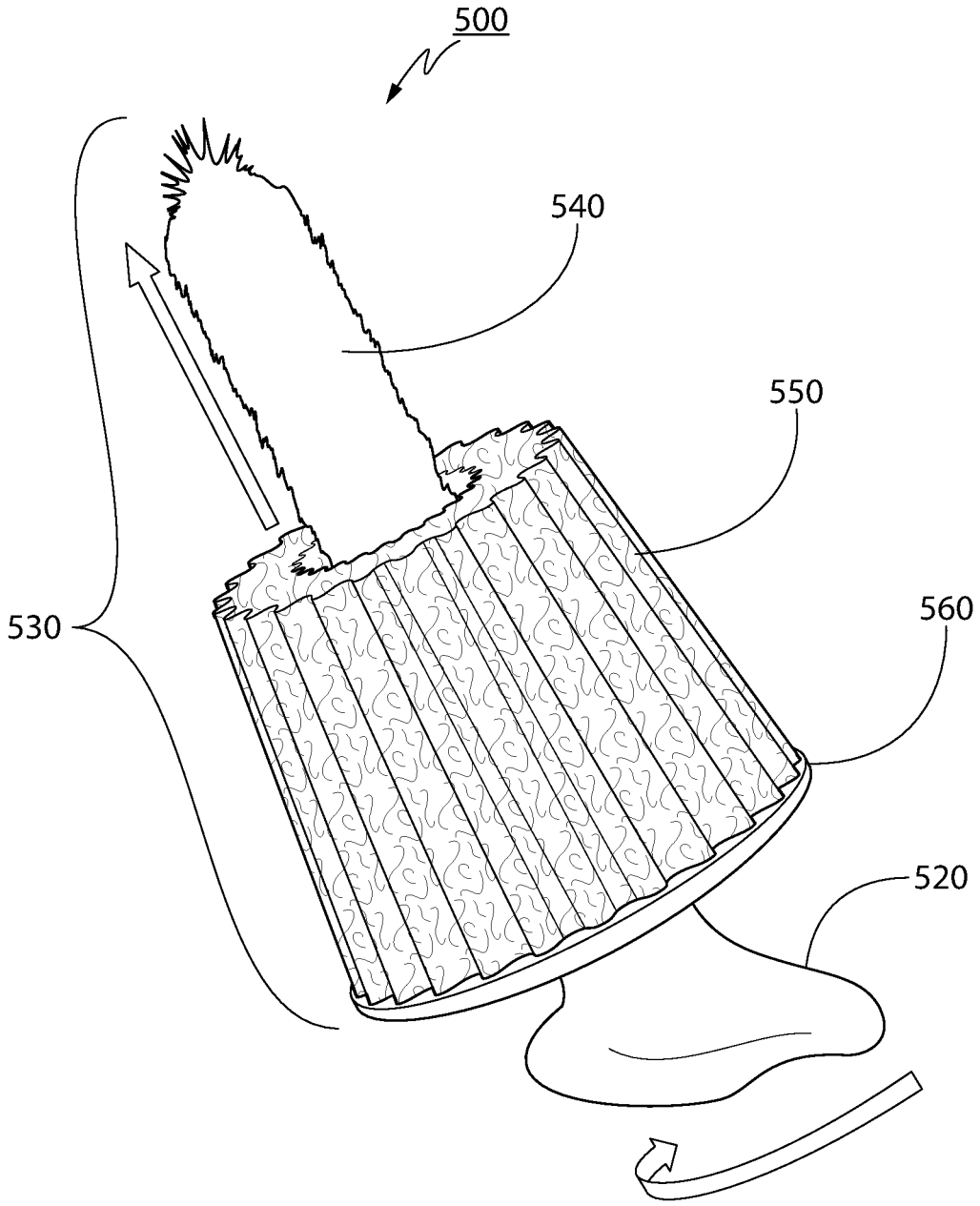
FIG. 5 shows an exemplary handheld implement in accordance with aspects of the present disclosure.

FIG. 5 shows an exemplary handheld implement 500 in accordance with aspects of the present disclosure. The handheld implement 500 can have a handle 520 and a head 530, which may be similar to those previously discussed herein. In accordance with aspects of the invention, the head 530 can include an interior section 540 and an exterior section 550. In embodiments, the exterior section 550 can be attached to a base 560 (e.g., which may include the shoulder 230). The interior section 540 can be mechanically linked to the handle 520 to extend in an axial direction with respect to the exterior section 550. For example, the interior section 540 can be an extendable cleaning wand and the exterior section 550 can be a kitchen brush. The user can manually extend the cleaning wand to, for example, clean hard-to-reach locations of a work item (e.g., narrow glassware). In embodiments, the handle 520 includes a central shaft that is threaded, and the base 560 includes a central though-hole having complementary threading. Accordingly, the wand (interior section 540) can be extended by twisting the handle 520 such that the shaft of the handle 520 screws into the base 560 along the threading, and retracted by twisting in the opposite direction.

Figure 6:
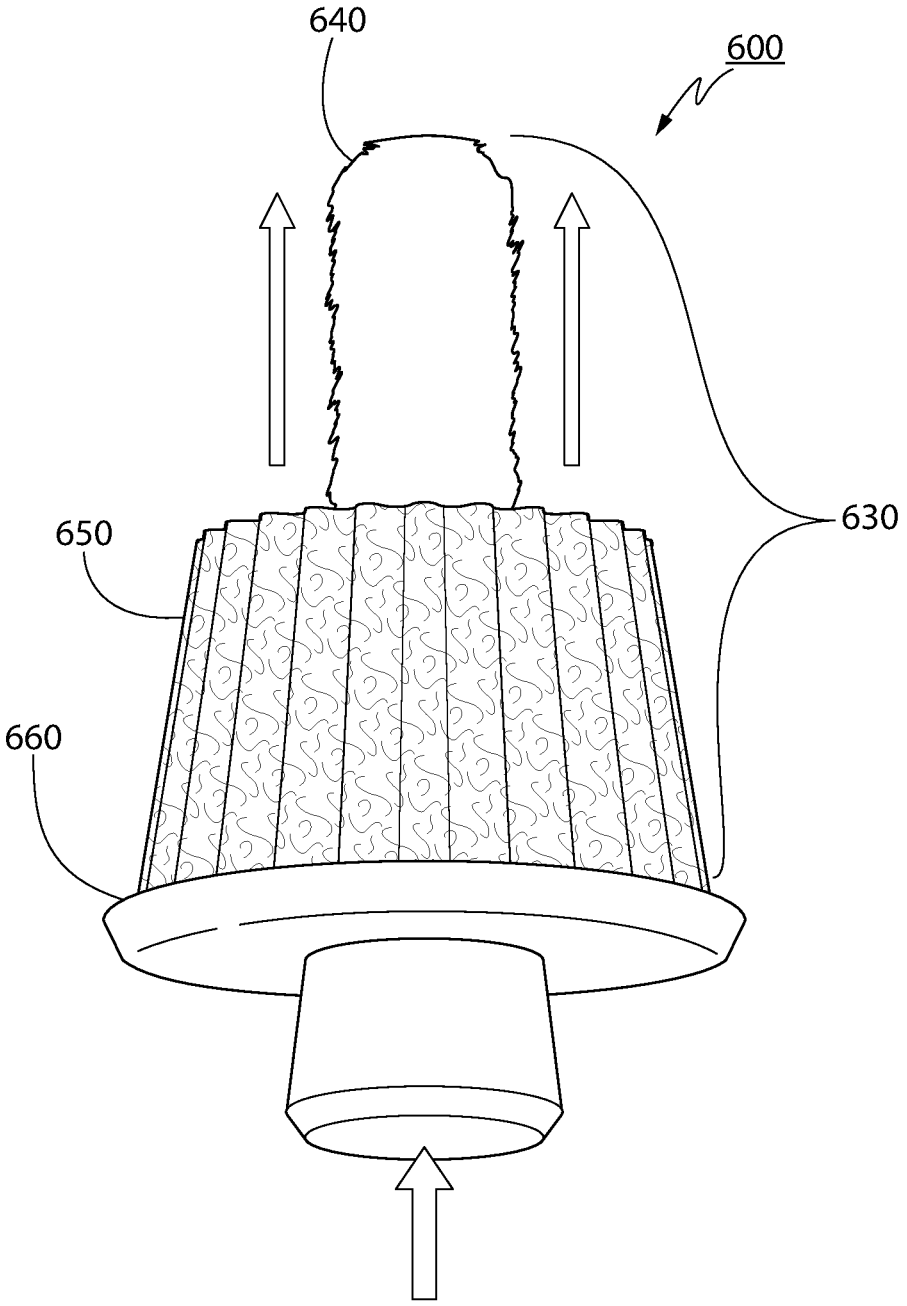
FIG. 6 shows an exemplary handheld implement in accordance with aspects of the present disclosure.

FIG. 6 shows an example of a handheld implement 600 in accordance with aspects of the present disclosure. The handheld implement 600 can have a handle 620 and a head 630, which may be similar to those previously discussed herein. In accordance with aspects of the invention, the head 630 can include an interior section 640 and an exterior section 650. In embodiments, the exterior section 650 can be attached to a base 660, which may be similar to those previously discussed herein. In embodiments, the handle 620 includes a central shaft, and the base 660 includes a central though-hole having a diameter that is substantially the same as the shaft. By this arrangement, the interior section 640 can be a plunger attached to the handle 620, such that pushing along the central axis of the handle 620 extends the interior section 640 in an axial direction with respect to the exterior section 650.

Figure 7:
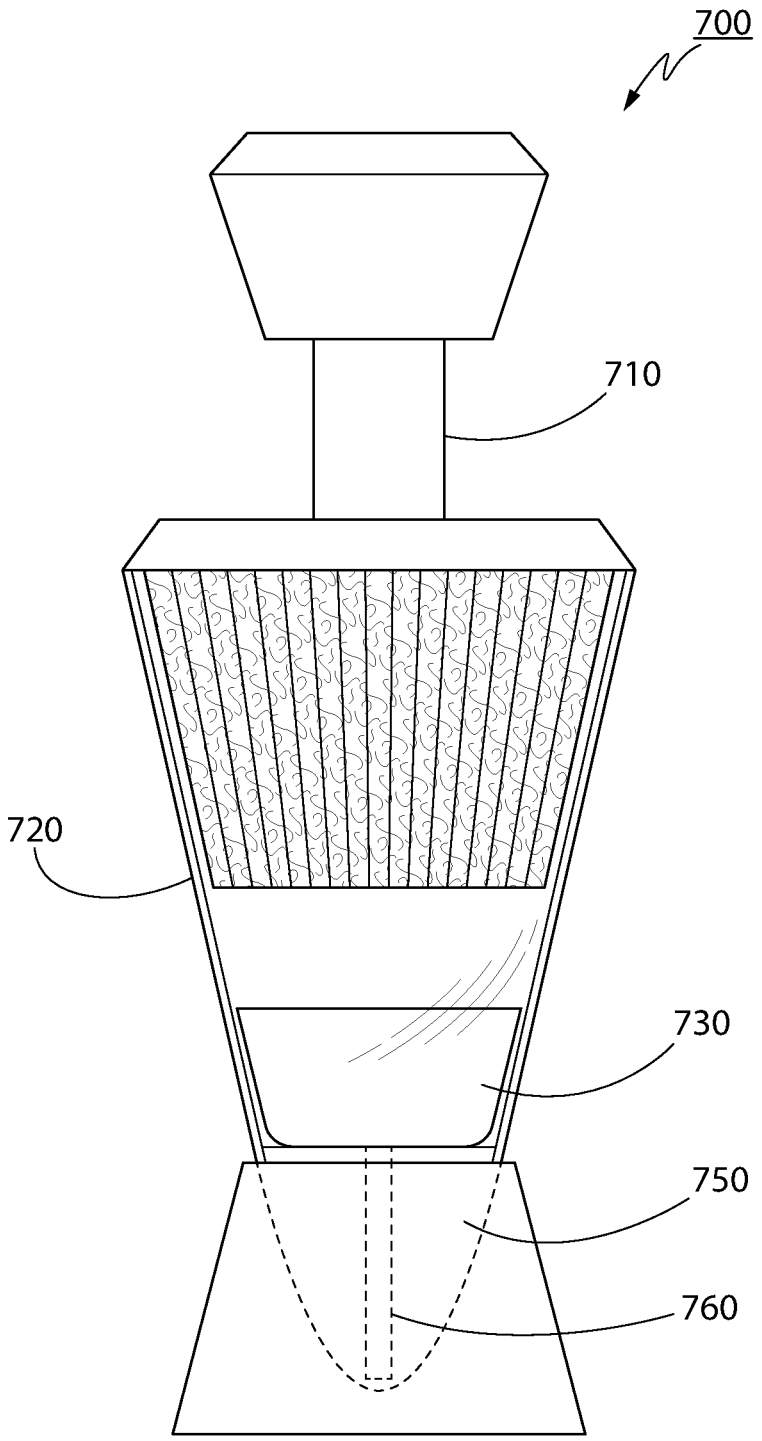
FIG. 7 shows an exemplary system in accordance with aspects of the present disclosure.

FIG. 7 shows an exemplary system 700 in accordance with aspects of the present disclosure. The system 700 can include a handheld implement 710, a basin 720, a pump 730, a product container 740, and reservoir 750, which can be similar to those previously discussed herein. In accordance with aspects of the disclosure the reservoir 750 has an oval (e.g., elliptical) shape such that the long axis of the oval is in a direction of the long axis of the system 700. A dip-tube 760 can extend from an intake of the pump 730 substantially along the long axis to the bottommost surface of the reservoir. Accordingly, the portion of the dip-tube 760 in the product is maximized as product in the reservoir 750 becomes depleted. Additionally, as described previously, the product container 740 can be removed and replaced or refilled. In accordance with aspects of the present disclosure, some or all of the product container 740 can be formed from clear or translucent material such that a user can visually determine an amount of product remaining in the reservoir 750.

Figure 8:
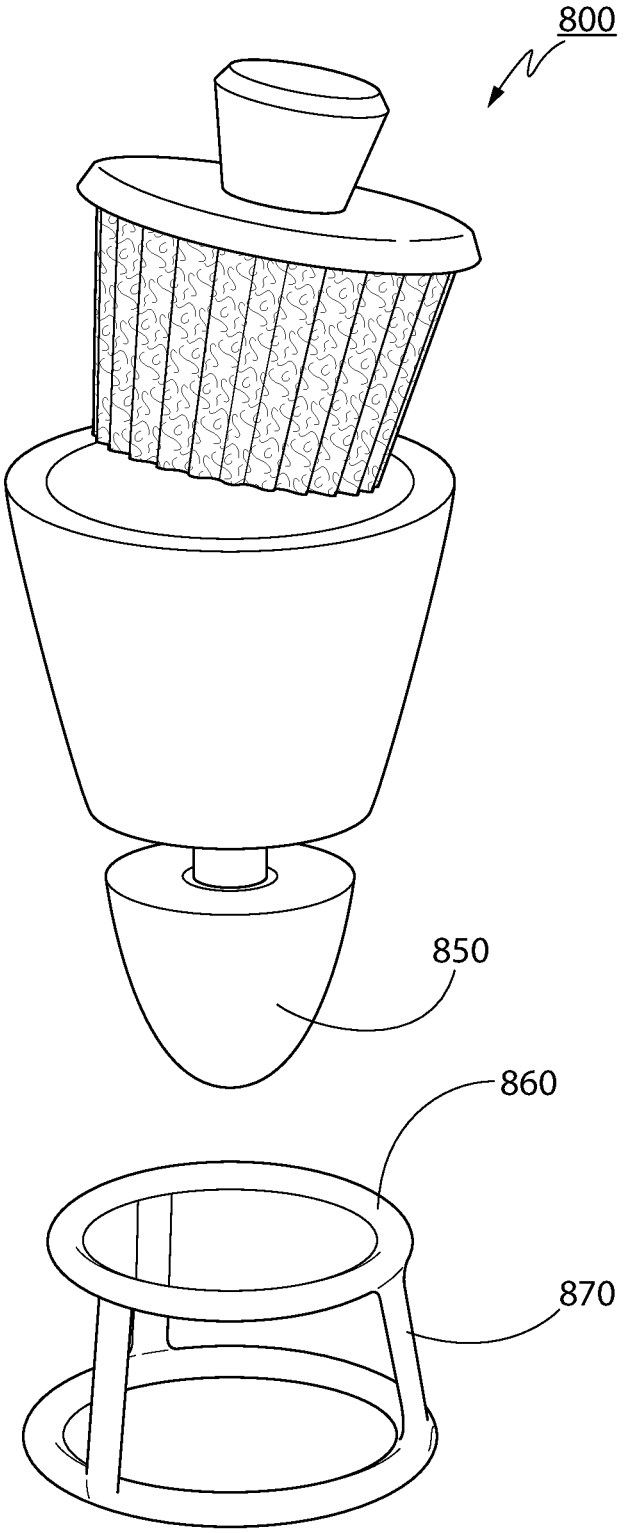
FIG. 8 shows an exemplary system in accordance with aspects of the present disclosure.

FIG. 8 shows an example of a system 800 in accordance with aspects of the present disclosure. The system 800 can be similar to that discussed previously with regard to FIG. 7. In embodiments, base 840 includes a separate reservoir 850 and base section 860. The reservoir 850 can have a half-oval (e.g., teardrop or elliptical) shape such that the long axis of the oval is in a vertical direction. Additionally, the base section 860 can be comprised of an open frame, as shown, that supports the system 800. The spaces between the legs 870 of the frame of the base section 860 allow a user to view the reservoir 850 to visually determine an amount of product remaining in the reservoir 850.

Figure 9A:
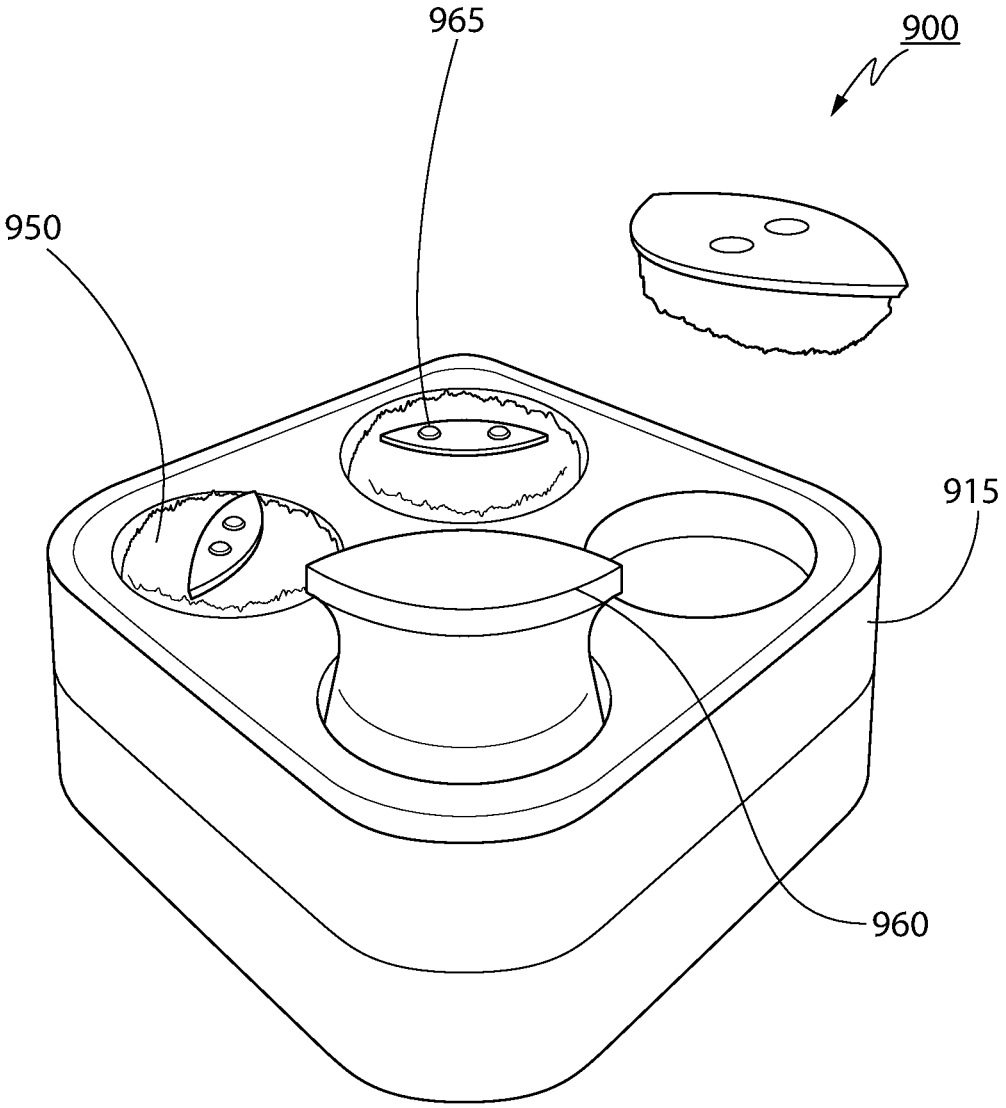
FIGS. 9A-9C show exemplary systems in accordance with aspects of the present disclosure.
Figure 9B:
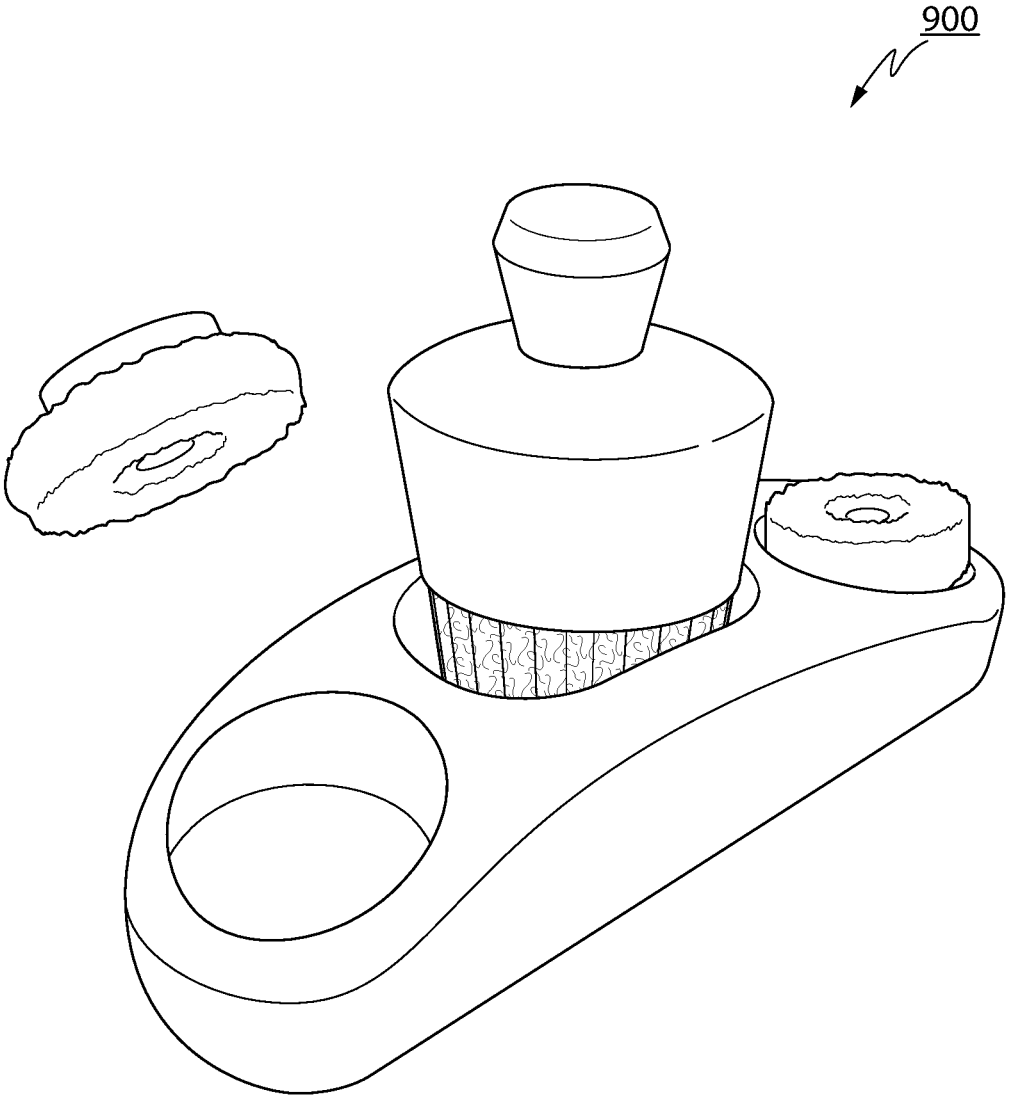

FIG. 9A shows an exemplary system 900 in accordance with aspects of the present disclosure. The system 900 can by similar to the systems described previously herein (e.g., system 100). In embodiments, the system 900 has a single housing 915 integrating four base units 930 arranged in a two-by-two array. Each of the base units 930 can be similar to the bases (e.g., base 30) previously described herein. It is understood that the system 900 can have other numbers of base units 930 arrayed in other shapes. For example, FIG. 9B shows an exemplary system 900' including three base units 930 in a one-by-three array.

Figure 9C:
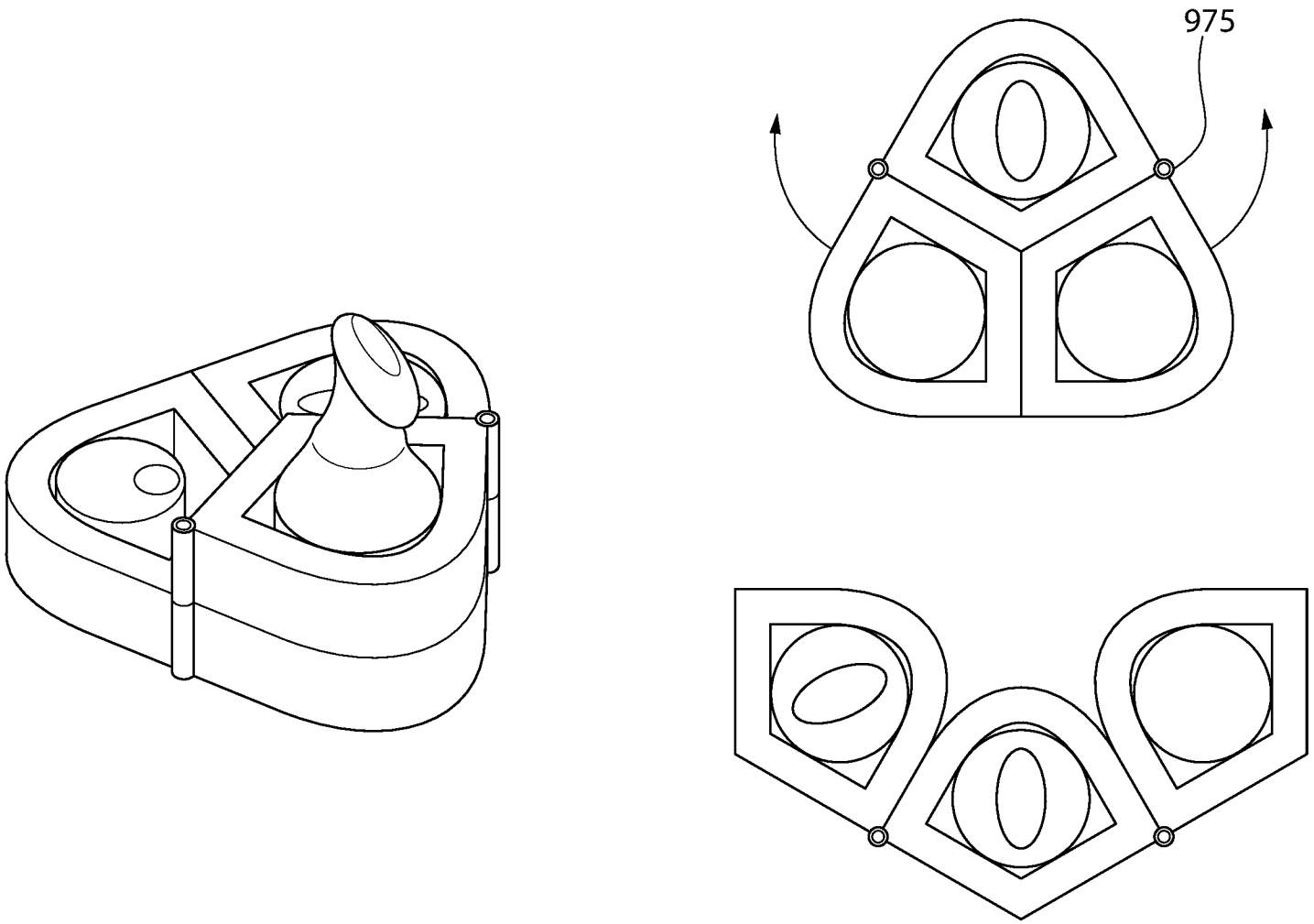

Additionally, in accordance with aspects of the present disclosure, a user can change the shape and/or order of the base units 930 in the housing 915. In embodiments, such as shown in FIG. 9C, the base units 930 can include one or more connectors 975 that connect at least a first one of the base units 930 to one or more other base units 930. In embodiments, the connectors 975 are articulated connectors, such as hinges. Accordingly, a user can change the shape of the housing 915 to adapt it to shapes of different work areas. For example, a user can manually change the system 900 from a folded (e.g., coiled) shape to a linear shape to fit on a narrow area of a countertop. Additionally, in embodiments, the user can rearrange the base units 930 and/or attach additional base units 930 using the connectors. For example, the user can assemble a set of base units 930 that only include scrubbing products and handheld implements. Or, the user can assemble a set of base units 930 that includes a mixture of scrubbing, cleaning, and polishing products and handheld implements. Accordingly, the user can customize the arrangement and/or contents of the base units 930 included in the system 900.

Referring back to FIG. 9A, each of the base units 930 can have a respective handheld implement 940, which may be the same or similar to those previously described herein (e.g., handheld implement 20). Additionally, each handheld implement 940 can lock into the base units 930 as previously described herein. For example, the handheld implements 940 can have heads 950 with threading on their peripheries that twist-lock into the bases units 930 or that are shaped to lock into the base units 930. In embodiments, the different heads 950 can share a universal handle 953 that interchangeably attaches to any of the heads 950 using a common type of connection. In embodiments, each head 950 can include a base 957 and an implement 959. The bases 957 can include one or more hardpoints 965 (e.g., detachable, mechanical connections) that securely connect the bases 957 of the heads 950 to the universal handle 953. For example, the hardpoints the 965 can be one or more openings 965 in the bases 957 into which respective pins on the universal handle 953 snap-fit. It is understood that other attachments techniques can be used. Further, in embodiments, the different heads 950 can have different shapes that are keyed to exclusively fit particular base units 930 containing different, respective products. For example, a head 950 having a scrubber implement 959 may be keyed for particular product containers containing abrasive products, while another head 950 having a sponge implement 959 may be keyed for a product container including dish soap.

Figure 10:
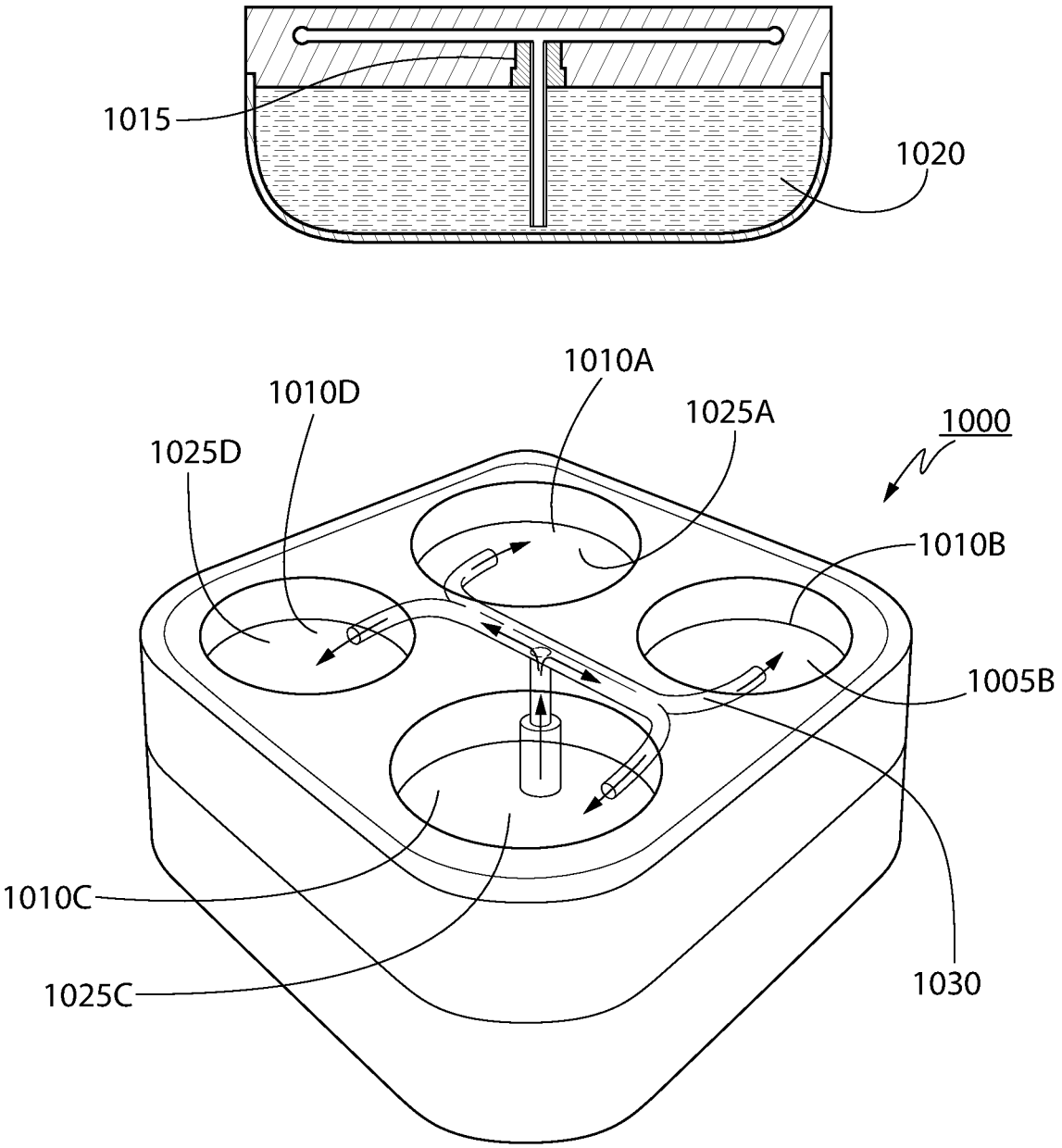
FIG. 10 shows an exemplary system in accordance with aspects of the present disclosure.

FIG. 10 shows an exemplar system 1000 in accordance with aspects of the present disclosure. The system 1000 can by similar to the systems described previously herein with regard to FIG. 9 (e.g., system 900), wherein there are multiple base units 1030 in a single housing. In embodiments, the base units 130 share a common pump 1040 that conveys product from common product container 1050 via a common collection point 1060 (e.g., a dip tube). A channel 1070 can convey product from the product container 1020 to inner cavities of each of the base units 1030.

In closing, it is to be understood that the embodiments disclosed herein are illustrative of the principles of the present invention. Other modifications that may be employed are within the scope of the invention. Thus, by way of example, but not of limitation, alternative configurations may be utilized in accordance with the teachings herein. Accordingly, the present invention is not limited to that precisely as shown and described.

What is claimed is:

1. A system comprising:

a handheld implement comprising a handle and a head; and a base comprising a basin, a pump, and a product container, wherein:

the basin comprises an opening to an inner cavity that receives the head of the handheld implement;

the product container includes a reservoir for a product; and the pump conveys the product from the reservoir to the inner cavity via at least one through-hole in the basin;

wherein the head of the handheld implement contacts a bottom of the inner cavity; and wherein the head of the handheld implement applies a plunging force to the pump.

2. The system of claim 1, wherein the system is a hand-washing system, the head is a kitchen brush, and the product is a liquid soap or liquid detergent.

3. The systems of claim 1, wherein the pump is a well-pump in a lower portion of the basin below the inner cavity.

4. The systems of claim 1, wherein product container is manually detachable from the basin.

5. The systems of claim 1, wherein the product container is replaceable.

6. The systems of claim 1, wherein the product container is refillable.

7. The systems of claim 1, wherein the handheld implement comprises a cap that seals the basin.

8. The systems of claim 1, wherein:

the opening comprises walls forming a mouth to the inner cavity;

the head of the handheld implement extends to a bottom of the inner cavity without substantially contacting the bottom; and the handle of the handheld implement applies a plunging force to the pump via the walls.

9. The systems of claim 1, wherein:

the head of the handheld implement comprises an outer portion and an inner portion;

the outer portion comprises a brush; and the inner portion comprises a wand axially extendable from the head using the handle.

10. The systems of claim 1, wherein the reservoir is separable from the base.

11. The systems of claim 1, wherein:

the reservoir has a partial-oval shape;

the long axis of the oval is in a direction of the vertical axis of the system; and a dip tube extends from an intake of the pump to a bottommost surface of the reservoir.

12. The systems of claim 1 further comprising:

a plurality of basins corresponding to a plurality of product containers; and a plurality of handheld implement heads corresponding to the plurality of basins;

wherein:

the plurality of product containers provide one or more products to the plurality of basins, and the plurality of handheld implement heads caps the plurality of basins.

13. The system of claim 12, further comprising:

a plurality of reservoirs; and a plurality of pumps;

wherein:

each of the plurality of basins is located above a respective one of the plurality of pumps;

each of the plurality of pumps is located above a respective one of the plurality of reservoirs; and the plurality of pumps convey the one or more products from the plurality of reservoirs to the plurality of basins.

14. The systems of claim 12, wherein:

each of the plurality of reservoirs contains a different, respective product;

a handle is connectable to each of the plurality of handheld implement heads to form a handheld implement;

each of the plurality of handheld implement heads have different shapes keyed to exclusively fit particular types of product containers in the plurality of product containers; and each of the plurality of handheld implement heads lock into respective ones of the plurality product containers.

* * * * *